US006626527B1

(12) United States Patent
Pinard

(10) Patent No.: US 6,626,527 B1
(45) Date of Patent: Sep. 30, 2003

(54) INTERLEAVED PRINTING

(75) Inventor: Adam I. Pinard, Carlisle, MA (US)

(73) Assignee: Creo Americas, Inc., Billerica, MA (US)

( * ) Notice: Subject to any disclaimer, the term of this patent is extended or adjusted under 35 U.S.C. 154(b) by 104 days.

(21) Appl. No.: 09/689,370

(22) Filed: Oct. 12, 2000

Related U.S. Application Data

(63) Continuation-in-part of application No. 09/041,211, filed on Mar. 12, 1998, now Pat. No. 6,511,163.

(51) Int. Cl.[7] ..... B41J 2/07; B41J 2/12
(52) U.S. Cl. ..... 347/74; 347/78; 347/79
(58) Field of Search ..... 347/77, 41, 73, 347/74, 76, 78, 79

(56) References Cited

U.S. PATENT DOCUMENTS

| | | | | | |
|---|---|---|---|---|---|
| 3,298,030 | A | | 1/1967 | Lewis et al. | 347/74 |
| 3,373,437 | A | | 3/1968 | Sweet et al. | 347/74 |
| 3,562,757 | A | | 2/1971 | Bischoff | 347/76 |
| 3,596,275 | A | | 7/1971 | Sweet | 347/74 |
| 3,723,646 | A | | 3/1973 | Behane et al. | 358/300 |
| 3,739,395 | A | * | 6/1973 | King | 347/77 |
| 3,827,057 | A | | 7/1974 | Bischoff et al. | 347/79 |
| 3,828,354 | A | | 8/1974 | Hilton | 347/79 |
| 3,895,386 | A | | 7/1975 | Keur et al. | 347/77 |
| 3,928,718 | A | | 12/1975 | Sagae et al. | 358/296 |
| 3,972,052 | A | | 7/1976 | Atumi et al. | 347/78 |
| 3,977,007 | A | * | 8/1976 | Berry et al. | 347/15 |
| 4,051,485 | A | | 9/1977 | Yamada | 347/77 |
| 4,065,773 | A | | 12/1977 | Berry | 210/780 |
| 4,069,485 | A | | 1/1978 | Martin | 347/12 |
| 4,085,409 | A | | 4/1978 | Paranjpe | 347/77 |
| 4,314,258 | A | | 2/1982 | Donahue et al. | 347/77 |
| 4,321,607 | A | | 3/1982 | Heibein et al. | 347/79 |
| 4,364,057 | A | | 12/1982 | Ebi et al. | 347/81 |
| 4,384,295 | A | | 5/1983 | Lewis et al. | 347/77 |
| 4,395,716 | A | | 7/1983 | Crean et al. | 347/76 |
| 4,424,518 | A | | 1/1984 | Suzuki et al. | 347/9 |
| 4,467,366 | A | | 8/1984 | Bobick et al. | 358/497 |
| 4,525,721 | A | | 6/1985 | Crean | 347/76 |
| 4,562,442 | A | | 12/1985 | Jinnai et al. | 347/76 |
| 4,596,990 | A | * | 6/1986 | Hou | 347/41 |
| 4,598,299 | A | | 7/1986 | Koike et al. | 347/79 |
| 4,620,198 | A | | 10/1986 | Behun | 347/43 |
| 4,667,830 | A | | 5/1987 | Nozaki, Jr. et al. | 209/3.1 |

(List continued on next page.)

FOREIGN PATENT DOCUMENTS

| | | | | |
|---|---|---|---|---|
| JP | 52-23346 A | * | 2/1977 | 347/77 |
| JP | 60-52356 A | * | 3/1985 | 347/74 |

OTHER PUBLICATIONS

Ghouse, "Simulation of a Nonlinear Fluid System Servo for Drop Flightime Control in an Ink–Jet Printer," Proceedings of the 1978 Summer Computer Simulation Conference, abstract, 1978.

Heinzl and Hertz, "Ink–Jet Printing," Advances in Electronics and Electron Physics, vol. 65, pp. 91–171, 1985.

IBM Journal of Research and Development, vol. 21, No. 1, pp. 1–96, Jan. 1997.

Samuelson, "Ink Jet Printing of Color Images, Dither Matrix and Halftone Methods," Department of Electrical Measurements, Lund Institute of Technology, pp. 58–59, Aug., 1985.

*Primary Examiner*—Hai Pham
(74) *Attorney, Agent, or Firm*—Kristofer E. Elbing

(57) ABSTRACT

A jet printer is disclosed that includes a print head attached to a movable carriage, with a deflection element having a deflection axis in the direction of an axis of rotation of a drum. A carriage mechanism can move the carriage in the direction of the axis of rotation of the drum. The printer also includes self-interleaving logic with an output provided to the print head, as well as a control circuit responsive to a swathing table and having an output provided to the deflection element.

22 Claims, 3 Drawing Sheets

U.S. PATENT DOCUMENTS 4,673,303 A * 6/1987 Sansone et al. ..... 347/103
4,809,016 A * 2/1989 Padalino ..... 347/41
4,942,462 A 7/1990 Shiota ..... 358/509
5,182,803 A 1/1993 Rodi et al. ..... 714/47
5,696,593 A 12/1997 Chiba et al. ..... 358/296
5,700,692 A 12/1997 Sweet ..... 436/50
5,870,112 A * 2/1999 Kang et al. ..... 347/41 X
5,946,454 A 8/1999 Shu et al. ..... 358/1.9
5,949,455 A * 9/1999 Williams ..... 347/76

* cited by examiner

INTERLEAVED PRINTING

CROSS-REFERENCE TO RELATED APPLICATION

This application is a continuation-in-part of a application entitled "Printing System," filed on Mar. 12, 1998, Ser. No. 09/041,211, now U.S. Pat. No. 6,511,163, issued on Jan. 28, 2003, which is herein incorporated by reference.

FIELD OF THE INVENTION

This invention relates to jet printers, including jet printers for direct-to-plate printing systems.

BACKGROUND OF THE INVENTION

Ink-jet printers operate by charging drops of ink with a charging electrode and guiding them to a print substrate through a high intensity electric field. Printers can modulate the charge on an ink drop by changing the charging electrode voltage to select whether each drop is to be printed or instead sent to a gutter. Printers may also adjust the charging voltage to compensate for aerodynamic effects and for the influence of the charge from adjacent drops. Some printers employ a technique known as "swathing" to continuously change the field and thereby direct drops from one or more stationary ink jets to different locations on the printing substrate, instead of moving a print head across the substrate.

Jet printing techniques are applicable to direct-to-plate printers. Such printers typically apply a printing fluid to a sheet of plate stock mounted on a drum. This fluid causes changes in the portions of the surface of the plate on which it is deposited. Although further processing of the plate may be necessary, the result is a printing plate that can serve to print large numbers of pages.

SUMMARY OF THE INVENTION

In one general aspect, the invention features a jet printer that includes a drum constructed and adapted to receive a print substrate and a drum control interface having an output provided to a motor for rotating the drum. The printer also includes a print head with a first jet printing fluid source attached to a movable carriage and at least one deflection element located proximate an output trajectory of the first jet printing fluid source. The deflection element has a deflection axis in the direction of an axis of rotation of the drum. Further included are a carriage mechanism for moving the carriage in the direction of the axis of rotation of the drum, a swathing table, interleaving logic with an output provided to the print head, and a control circuit responsive to the swathing table and having an output provided to at least the one deflection element.

In preferred embodiments, the print head can further include a second jet printing fluid source attached to the carriage, with the interleaving logic being operative to provide interleaved portions of data to be printed by the first and second jet printing fluid sources. The interleaving logic can include horizontal and/or vertical interleaving logic. The printer can further include a processor portion operative to drive the printer to print half-tone images on a print substrate. The print substrate can be a printing plate. The deflection element can be a charging tunnel surrounding an output of the jet printing fluid source. The deflection element can be one of a pair of deflection electrodes. The swathing table can include a series of different firing order entries that define different deflection amounts for the deflection element, whereby the deflection element directs drops from the printing fluid source to a succession of different locations on the printing substrate.

In another general aspect, the invention features a method of jet printing that includes moving a first jet printing fluid source relative to a print substrate along the direction of an axis of rotation of a print substrate. A first drop of printing fluid from the jet printing fluid source is electromagnetically guided so that it lands on the print substrate at a first distance along the direction of the axis of rotation of the print substrate from the jet printing source and at a first distance along the direction of advance of the print substrate. A second drop of printing fluid from the jet printing fluid source is electromagnetically guided so that it lands on the print substrate at a second distance along the direction of the axis of rotation of the print substrate from the jet printing source, with the first and second distances being different The method also includes rotating the print substrate relative to the jet printing fluid source about the axis of rotation after the step of electromagnetically guiding a first drop to advance the print substrate, and depositing a third drop adjacent the first drop after the step of rotating and according to an interleaved print pattern.

In preferred embodiments, the step of depositing can include depositing the third drop by a second jet printing fluid source between the-first and second drops in the direction of the axis of rotation of the print substrate. The step of depositing can include depositing the third drop by the first jet printing fluid source between the first and second drops in the direction of the axis of rotation of the print substrate, with the deposition of the first and third drops being separated in time by at least about a full revolution of the drum. The step of depositing can include depositing the third drop adjacent the first drop by a second jet printing fluid source at a second distance along the direction of advance of the print substrate, with the first and second distances along the direction of advance of the print substrate being different. The step of depositing can include depositing the third drop adjacent the first drop by the first jet printing fluid source at a second distance along the direction of advance of the print substrate, with the first and second distances along the direction of advance of the print substrate being different, and with the deposition of the first and third drops being separated in time by at least about a full revolution of the drum. The steps of moving, guiding, rotating, and depositing can form a part of a half-tone printing process and/or can be performed using a printing plate as a substrate.

In a further general aspect, the invention features a jet printer that includes means for moving a jet printing fluid source relative to a print substrate along a direction of an axis of rotation of a print substrate, means for rotating the print substrate relative to the jet printing fluid source about the axis of rotation to advance the print substrate, means for electromagnetically guiding a first drop of printing fluid from the jet printing fluid source so that it lands on the print substrate at a first distance along the direction of the axis of rotation of the print substrate from the jet printing source and at a first distance along the direction of advance of the print substrate, and for electromagnetically guiding a second drop of printing fluid from the jet printing fluid source so that it lands on the print substrate at a second distance along the direction of the axis of rotation of the print substrate from the jet printing source, wherein the second distance is different from the first distance, and means for causing a third drop to be deposited adjacent the first drop after the drum has rotated and according to an interleaved print pattern.

In preferred embodiments, the means for causing can include means for causing the third drop to be deposited by a second jet printing fluid source between the first and second distances in the direction of the axis of rotation of the print substrate. The means for causing can include means for causing the third drop to be deposited by the first jet printing fluid source between the first and second drops in the direction of the axis of rotation of the print substrate, with the deposition of the first and third drops being separated in time by at least about a full revolution of the drum. The means for causing can include means for causing the third drop to be deposited adjacent the first drop by a second jet printing fluid source at a second distance along the direction of advance of the print substrate, with the first and second distances along the direction of advance of the print substrate being different. The means for causing can include means for causing the third drop to be deposited adjacent the first drop by the first jet printing fluid source at a second distance along the direction of advance of the print substrate, with the first and second distances along the direction of advance of the print substrate being different, and with the deposition of the first and third drops being separated in time by at least about a full revolution of the drum. The printer can include means for driving the printer to print half-tone images on a print substrate. The print substrate can be a printing plate.

Systems according to the invention can be advantageous in that they provide an inexpensive, accurate and flexible method of controlling the trajectory of drops of printing fluid in jet printing. By treating drops as samples in a sampled-data system, printers can perform swathing, aerodynamic compensation, and adjacent drop compensation in the digital domain using an existing printer control processor or an inexpensive add-on microprocessor. Such printers can also be reconfigured for different printing applications without requiring a redesigned analog circuit, and they may even be digitally calibrated at start-up or on-the-fly to improve print characteristics. These features can improve the quality of printing, and can reduce the cost and time involved in developing improved printers.

Systems according to the invention may also permit printing operations to take place more quickly and efficiently, in moving-head, direct-to-plate, jet printers. Swathing can permit such printers to deposit individual charged drops that are spaced apart in two polar dimensions on a plate as it rotates. And interleaving can increase drop spacing as well. This allows for fine-pitch printing at high speeds with a minimum number of guard drops.

DETAILED DESCRIPTION OF AN ILLUSTRATIVE EMBODIMENT

Figure 1:
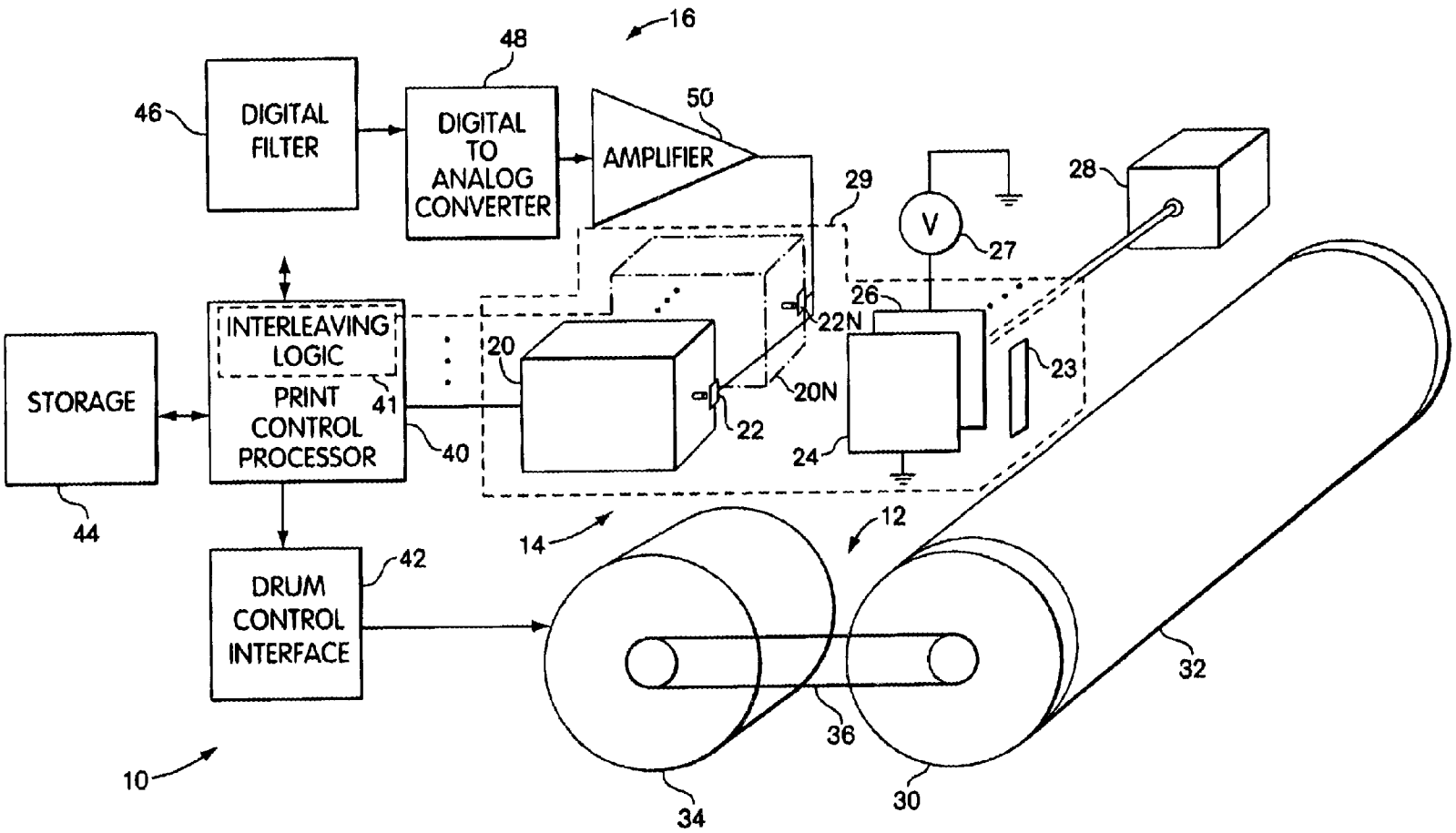
FIG. 1 is a system-level block diagram illustrating elements of a jet printer according to the invention.

A jet printer 10 according to the invention includes a print substrate feed mechanism 12, a print head assembly 14, and a control circuit 16. The feed mechanism includes a print drum 30, which supports a print substrate 32, such as a piece of paper print stock or a printing plate. A motor 34 drives the drum 30 via a coupling mechanism 36.

The print head assembly 14 includes a print head that includes one or more nozzle assemblies 20 . . . 20 N each having a charging electrode 22 . . . 22N, such as a charging tunnel, at its output. A pair of deflection electrodes (e.g., 24, 26) is located on opposite sides of the path that a drop takes when exiting the nozzle. The deflection electrodes, the charging tunnel, and the nozzle assembly are all mounted on a carriage 29 driven by a carriage actuator 28. The carriage actuator is operative to move the carriage along a path that is parallel to the axis of rotation of the drum.

The control circuit 16 includes a print control processor 40 that can include interleaving logic 41 and has a control output provided to a drum control interface 42. The print control processor also has a data port operatively connected to a data port of a storage element 44, and a data port operatively connected to a digital filter 46. The digital filter has an output provided to a digital input of a digital-to-analog converter 48, which has an analog output provided to an input of a high-voltage amplifier 50. The amplifier has an output that is operatively connected to the charging electrode 22. Also provided is a high-voltage source 27 that can be controlled by the print control processor 40 and that has an output operatively connected to one of the deflection electrodes 26. The other deflection electrode 24 can be operatively connected to a fixed voltage source, such as ground.

FIG. 1 is intended as a general illustration of a printer according to the invention, and one of skill in the art would be able to modify its design in a number of ways while still obtaining benefits from the invention for different applications. For example, a number of different mechanisms can be used for the carriage actuator such as toothed-belt or lead-screw mechanisms. And while a drum-based feed mechanism 12 is appropriate for printing directly on lithographic plates, other printing applications may employ different kinds of mechanisms, such as continuous feed paper on a platten.

Features and functionality of the various circuit elements shown in FIG. 1 can also be combined in different ways. For example, the print control processor 40 can incorporate control routines that control the motor 34, allowing a signal from the print control processor or a simple buffered version of that signal to drive the motor. This eliminates the need for a dedicated hardware drum control circuit 42, which receives only a simple on/off signal from the print control processor. The print control processor can be located inside the printer, or it can be located remote from the printer and communicate with the printer, such as via serial cable.

Note that it is also possible to apply the invention to different types of deflection configurations by modulating the excitation provided to one or more of its deflection elements. For example, it is possible to modulate the voltage on the deflection electrodes 24, 26 instead of, or in addition to, modulating the voltage on the charging electrode 22. In addition, it is also possible to operate a jet printer without a charging electrode and modulate only a voltage on one or more deflection electrodes. It is also possible to modulate other approaches to guiding a drop, such as by modulating a magnetic field instead of an electric field.

Figure 2:
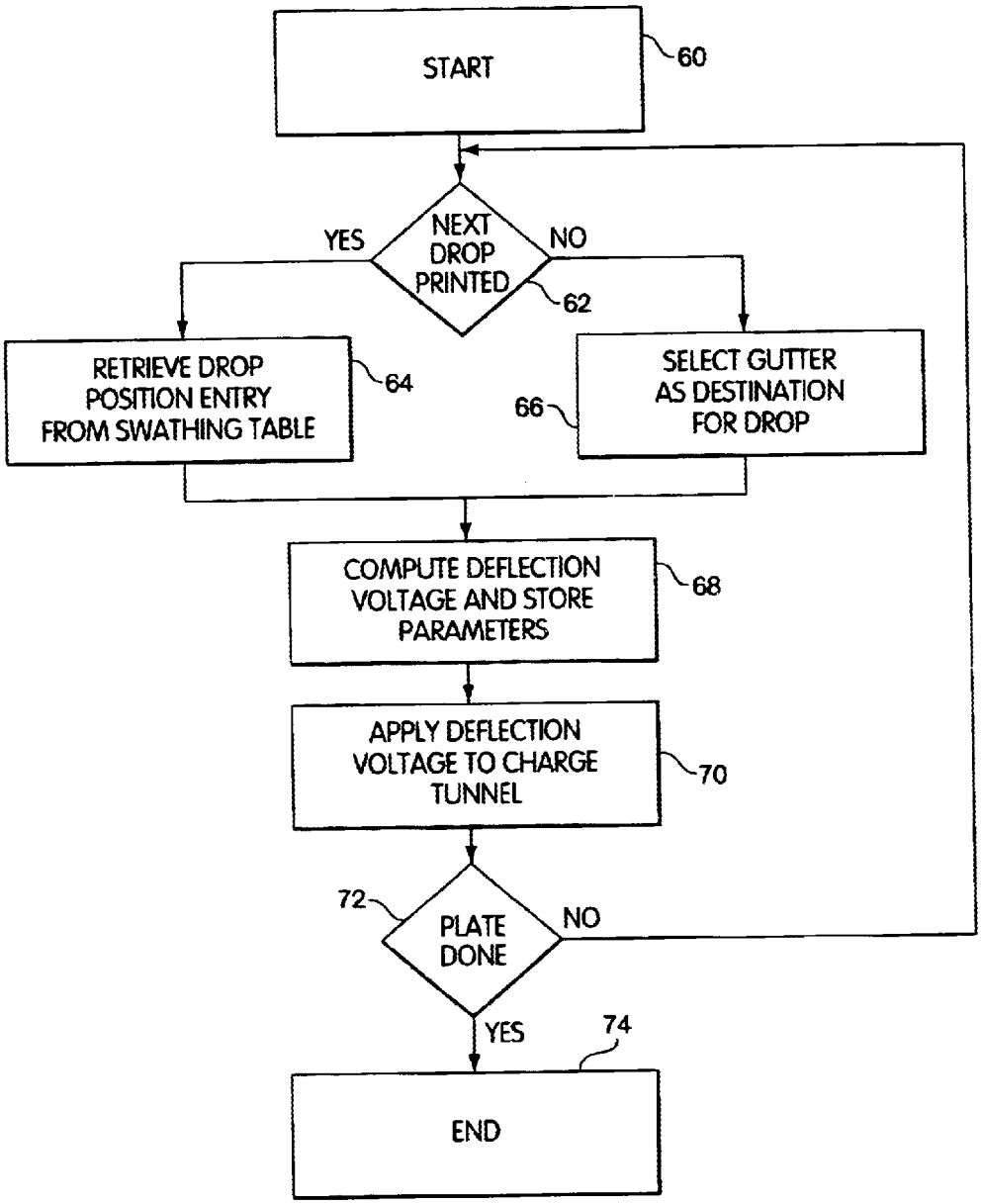
FIG. 2 is a flow chart illustrating the operation of the printer of FIG. 1.

In operation, referring to FIGS. 1 and 2, operation of the jet printer 10 begins with operator set-up of the printer and a software start command (step 60). In the case of a direct-to-plate printer that prints on aluminum or plastic plates, an operator first mounts a fresh plate 32 on the printer's drum 30. The operator then causes a host system to download data representing the material to be printed into the print control processor 40. The print control processor can also download coefficients into the digital filter 46, or run a calibration routine to derive these coefficients, if these are not stored locally. Calibration can be performed by depositing printing fluid drops on a calibration needle and adjusting the filter coefficients until an optimal transfer function has been reached. The processor can then instruct the drum control interface 42 to start the motor 34, which causes the drum 30 to rotate.

After the drum is up to speed, the print control processor 40 instructs the nozzle assembly 20 to generate a series of charged printing fluid drops, which pass through the charging electrode 22 and then between the deflection electrodes 24, 26. The magnitude of the voltage to be applied to the charging electrode 22 by the amplifier 50 depends on whether and where each particular drop is to be printed (step 62). If a drop is not to be printed, such as in the case of a guard drop, the print control processor 40 will select a gutter or knife edge 23 as the destination for the drop (step 66). The print control processor will then compute an appropriate voltage to be applied to the charging electrode given the voltage between the deflection electrodes, to guide the drop into the gutter (step 68). Typically, this voltage is either the maximum or minimum voltage that the amplifier is configured to provide.

If the drop is to be printed, the print control processor 40 retrieves a drop position entry from a swathing table, which can be stored in the storage 44 (step 64). The entries in the swathing table are designed to cause successive, but non-adjacently deposited, drops to be separated from each other on the plate radially due to rotation of the drum and longitudinally due to the swathing. Because the drops are spaced in this way in these two polar dimensions, they will not touch each other. This is particularly important in half-tone printing, where only single, separate drops are deposited. Of course, the order in which the print data is sent to the print head must take the swathing sequence into consideration.

Superimposed on the swathing voltage is a voltage derived by the digital filter 46, which compensates for aerodynamic effects and for the influence of the charge on adjacent drops. The digital filter can be an Infinite-Impulse-Response (IIR) filter implemented using a digital signal processor, such as the TMS 320C203 integrated circuit available from Texas Instruments. The filter function implemented is:

$$\mathrm{OUT}(n)=B0*\mathrm{IN}(n)+B1*\mathrm{IN}(n-1)+B2*\mathrm{IN}(n-3)+A1*\mathrm{OUT}(n-1)+A2*\mathrm{OUT}(n-2)$$

Coefficients used in the function for one embodiment are:

TABLE 1

| IIR Coefficients | |
|---|---|
| b0 | 0.05 |
| b1 | 0.67 |
| b2 | −0.32 |
| a1 | 0.6 |
| a2 | 0 |

Where IN(n) represents the desired position of drop number n, and OUT(n) represents the electrode voltage for drop number n resulting from the application of the filter. In a system that has sufficient computational capacity, it is contemplated that further coefficients could be included in this function. Digital filter design is discussed in, for example, "Digital Signal Processing," Chapter 5, Alan VanOppenheim and Ronald W. Schafer, Prentice-Hall Inc. (1975), which in herein incorporated by reference.

Table 2 illustrates the operation of the digital filter for the initial drops to be printed in a print job. As can be seen from this table, charge interaction between drops and aerodynamic effects cause the filter voltage required to place the drop at a desired position to change from drop to drop.

TABLE 2

| Drop Number | Normalized Desired Drop Position | Normalized Charging Voltage |
|---|---|---|
| 0 | 1 | 0.050 |
| 1 | 1 | 0.750 |
| 2 | 1 | 0.850 |
| 3 | 1 | 0.910 |
| 4 | 1 | 0.946 |
| 5 | 1 | 0.968 |
| 6 | 1 | 0.981 |
| 7 | 1 | 0.988 |
| 8 | 0 | 0.943 |
| 9 | 0 | 0.246 |
| 10 | 0 | 0.147 |
| 11 | 0 | 0.088 |
| 12 | 0 | 0.053 |
| 13 | 0 | 0.032 |
| 14 | 0 | 0.019 |
| 15 | 0 | 0.011 |
| 16 | 0 | 0.007 |

Once the charging voltage has been computed, the digital filter supplies a code corresponding to that voltage to the digital-to-analog converter 48. The digital-to-analog converter converts this code into an analog voltage, which it presents on its analog output. The amplifier 50 then amplifies the analog voltage to a high level, which is applied to the charging electrode 22 (step 70).

When a final drop has been sent (step 72), the printer can be powered down, or a new print operation can begin (step 74). If drops remain to be printed, the process of determining a charging electrode voltage begins again for the next drop (step 62).

In one particular embodiment, a printer employs a continuous jet head that has multiple jet assemblies and employs swathed bitmap capability to print up to 16 rasters per revolution per channel in a helical progression about the drum. This high resolution bitmap capability allows every drop to be used on halftone images without any of them merging.

It has been empirically determined that 1200 dots per inch (DPI) can be accomplished using a 10 um nozzle at jet velocity of 50 m/s printing a 16 pixel wide swath with a firing order of: 0, 8, 4, 12, 1, 9, 5, 13, 2, 10, 6, 14, 3, 11, 7, 15. This order is stored as a series of charge values in a 32-entry swathing table that also has an entry for non-printing drops, although other types of swathing tables can be used as well. The separation on the individual charges corresponds to a voltage of approximately 4 volts. This requires a total voltage swing of about 128 volts on the charging electrode. A nominal separation of 64 volts between printed and non-printed drops provides sufficient separation for the knife edge to operate properly.

The deflection voltage on the nozzle assemblies is programmable by software from 0 to 2200 Volts, and the deflection voltages for each nozzle assembly are to be sensed individually. Stimulation is common for all nozzle assemblies and is a square wave with an amplitude that can be controlled from 2.5 to 41 Volts. The charging voltage output has 1024 discrete levels between ±35 and −115 Volts with a settling time of 125 ns.

Figure 3:
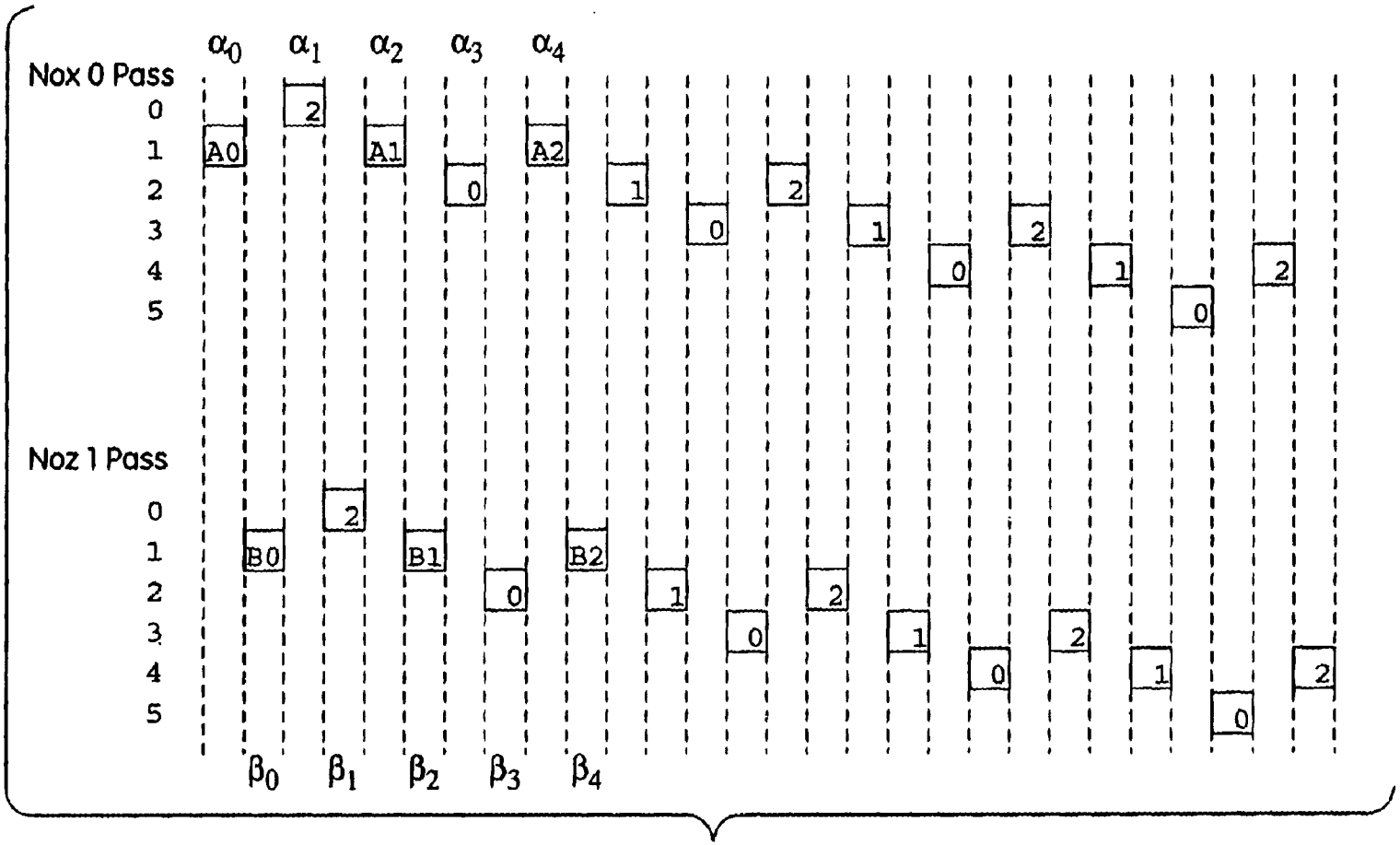
FIG. 3 is an interleaving diagram for a two-nozzle interleaving and three-channel swathing printer.

Referring to FIG. 3, it is advantageous to combine interleaving and swathing in printers according to the invention.

In such a system, a print head that includes a series of jets spaced along the direction of rotation of the drum simultaneously prints in parallel swathed helical progressions with offset rasters. This combination of swathing and interleaving allows for fast printing and a high degree of separation of the deposited ink drops.

An illustrative printing sequence is shown in FIG. 3 for a printer with two nozzles that and each employ three-channel swathing, and that are interleaved with each other and with themselves. In this example, a first nozzle deposits its ink drops at equally spaced intervals during a first revolution. During a second revolution, the first nozzle again deposits its ink drops at equally spaced intervals, but places them between the drops deposited during the first revolution.

At the same time, a second nozzle is also depositing its ink drops at equally spaced intervals, but these are offset from the positions used by the first channel, such that they fall in the gaps left by the first nozzle. The result is an interleaved printing sequence where adjacent drops from one jet are printed on different revolutions, and where these drops are also separated by adjacent drops from another jet.

In the illustrated horizontally interleaved print progression, a first jet deposits a first drop A0 in a first stripe $\alpha$0. It then deposits a second drop A1 in a third stripe $\alpha$2. Finally, it deposits a third drop A3 in a fifth stripe $\alpha$4. This pattern begins again as the print head advances with respect to the substrate while printing in even-numbered stripes.

During the same pass of the print head, a second jet is depositing a second swath, at a different position along the direction of rotation of the drum. This second swath begins when the second jet deposits a first drop B0 in a first offset stripe $\beta$1. It then deposits a second drop B1 in a third offset stripe $\beta$2. Finally, it deposits a third drop B2 in a fifth offset stripe $\beta$4. This pattern begins again as the print head advances with respect to the substrate while printing in even-numbered offset stripes.

During the same pass of the next revolution, the first jet will fill in remaining gaps by depositing drops in the odd-numbered stripes (i.e., $\alpha$1, $\alpha$3, etc.). Similarly, the second jet will fill in remaining gaps by depositing drops in the odd-numbered offset stripes (i.e., $\beta$1, $\beta$3, etc.).

The illustrated print order employs horizontal interleaving to separate drops in the direction of the axis of rotation of the drum. This effect can also be accomplished in the direction of rotation of the drum by performing vertical interleaving, in which adjacent print lines are deposited on different passes or even different rotations of the drum. And both horizontal and vertical interleaving can be performed by just a single jet, by interleaving over multiple passes and/or rotations.

For the purpose of clear illustration, the example shown in FIG. 3 employs a left-to-right firing order. It is also advantageous to combine interleaving and jumbled swathing order, however, to achieve a high degree of spacing between drops, and to avoid the creation of Moiré patterns. In one embodiment, it is believed that satisfactory 2400 DPI printing can be accomplished using the interleaving presented in connection with FIG. 3 and a 15-drop swath width. The firing order for this embodiment is 1, 8, 4, 13, 0, 6, 10, 3, 14, 7, 11, 2, 9, 5, 12. By appropriate selection of the type of interleaving and the number of swathing and interleaving channels, printing speed and resolution can be optimized for the deposition characteristics of a particular print head, ink, and substrate combination. Preferably, the carriage and drum are advanced continuously to achieve a smooth and precise helical progression, allowing for high precision deposition of ink drops.

The interleaving can be implemented using interleaving logic that directs appropriate pixels to the interleaved jets. This logic can be implemented in a number of ways, including by the use of dedicated logic circuitry, look-up tables, or software running on a processor, such as a print control processor for a multi-source print head. The logic can be separate from the logic implementing the swathing table, or the two functions may be implemented with some overlap.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto. In addition, the order of presentation of the claims should not be construed to limit the scope of any particular term in the claims.

What is claimed is:

1. A jet printer, comprising:

a drum constructed and adapted to receive a print substrate, a drum control interface having an output provided to a motor for rotating the drum, a movable carriage, a print head including a first jet printing fluid source attached to the carriage and at least one deflection element located proximate an output trajectory of the first jet printing fluid source, the deflection element having a deflection axis in the direction of an axis of rotation of the drum, a carriage mechanism for moving the carriage in the direction of the axis of rotation of the drum, a swathing table, self-interleaving logic having an output provided to the print head, and a control circuit responsive to the swathing table and having an output provided to at least the one deflection element.

2. The jet printer of claim 1 wherein the print head further includes a second jet printing fluid source attached to the carriage and further including further interleaving logic operative to provide interleaved portions of data to be printed by the first and second jet printing fluid sources.

3. The jet printer of claim 1 wherein the interleaving logic includes horizontal interleaving logic.

4. The jet printer of claim 3 wherein the interleaving logic includes vertical interleaving logic.

5. The jet printer of claim 1 wherein the interleaving logic includes vertical interleaving logic.

6. The jet printer of claim 1, further including a processor portion operative to drive the printer to print half-tone images on a print substrate.

7. The jet printer of claim 1 wherein the print substrate is a printing plate.

8. The jet printer of claim 1 wherein the deflection element is a charging tunnel surrounding an output of the jet printing fluid source.

9. The jet printer of claim 1 wherein the deflection element is one of a pair of deflection electrodes.

10. The jet printer of claim 1 wherein the swathing table includes a series of different firing order entries that define different deflection amounts for the deflection element, whereby the deflection element directs drops from the printing fluid source to a succession of different locations on the printing substrate.

11. A method of jet printing, comprising the steps of:

moving a first jet printing fluid source relative to a print substrate along the direction of an axis of rotation of the print substrate, electromagnetically guiding a first drop of printing fluid from the first jet printing fluid source so that it lands on the print substrate at a first distance along the direction of the axis of rotation of the print substrate from the first jet printing fluid source and at a first distance along the direction of advance of the print substrate, electromagnetically guiding a second drop of printing fluid from the first jet printing fluid source so that it lands on the print substrate at a second distance along the direction of the axis of rotation of the print substrate from the first jet printing fluid source, wherein the second distance is different from the first distance along the direction of the axis of rotation of the Print substrate, rotating the print substrate relative to the first jet printing fluid source about the axis of rotation after the step of electromagnetically guiding a second drop to advance the print substrate, depositing a third drop from the first jet printing fluid source at least generally between the first and second drops after the step of rotating and according to a self-interleaved print pattern, and depositing a fourth drop by a second jet printing fluid source at least generally between the first and second drops in the direction of the axis of rotation of the print substrate.

12. The jet printing method of claim 11 wherein the steps of moving, guiding, rotating, and depositing form a part of a half-tone printing process.

13. The jet printing method of claim 11 wherein the steps of moving, guiding, rotating, and depositing are performed using a printing plate as the print substrate.

14. A method of jet printing, comprising the steps of:

moving a first jet printing fluid source relative to a print substrate along the direction of an axis of rotation of a drum supporting the print substrate, electromagnetically guiding a first drop of printing fluid from the first jet printing fluid source so that it lands on the print substrate at a first distance along the direction of the axis of rotation of the print substrate from the first jet printing fluid source and at a first distance along the direction of advance of the print substrate, electromagnetically guiding a second drop of printing fluid from the first jet printing fluid source so that it lands on the print substrate at a second distance along the direction of the axis of rotation of the print substrate from the jet printing source, wherein the second distance is different from the first distance along the direction of the axis of rotation of the print substrate, rotating the drum relative to the jet printing fluid source about the axis of rotation after the step of electromagnetically guiding a second drop to advance the print substrate, and depositing a third drop from the first jet printing fluid source at least generally between the first and second drops after the step of rotating and according to a self-interleaved print pattern, wherein the deposition of the second and third drops are separated in time by about a full revolution of the drum.

15. The jet printing method of claim 14 wherein the steps of moving, guiding, rotating, and depositing form a part of a half-tone printing process.

16. The jet printing method of claim 14 wherein the steps of moving, guiding, rotating, and depositing are performed using a printing plate as a the print substrate.

17. A Jet printer, comprising:

means for moving a jet printing fluid source relative to a print substrate along a direction of an axis of rotation of a drum supporting the print substrate, means for rotating the drum relative to the jet printing fluid source about the axis of rotation to advance the print substrate, means for electromagnetically guiding a first drop of printing fluid from the jet printing fluid source so that it lands on the print substrate at a first distance along the direction of the axis of rotation of the print substrate from the jet printing fluid source and at a first distance along the direction of advance of the print substrate, and for electromagnetically guiding a second drop of printing fluid from the jet printing fluid source so that it lands on the print substrate at a second distance along the direction of the axis of rotation of the print substrate from the jet printing fluid source, wherein the second distance is different from the first distance along the direction of the axis of rotation of the Print substrate, means for causing a third drop to be deposited at least generally between the first and second drops after the drum has rotated and according to an interleaved print pattern, and further including means for causing a fourth drop to be deposited by a second jet printing fluid source at least generally between the first and second drops.

18. The jet printer of claim 17 further including means for driving the printer to print half-tone images on the print substrate.

19. The jet printer of claim 17 wherein the print substrate is a printing plate.

20. A jet printer, comprising:

means for moving a jet printing fluid source relative to a print substrate along a direction of an axis of rotation of a drum supporting the print substrate, means for rotating the drum relative to the jet printing fluid source about the axis of rotation to advance the print substrate, means for electromagnetically guiding a first drop of printing fluid from the jet printing fluid source so that it lands on the print substrate at a first distance along the direction of the axis of rotation of the print substrate from the jet printing fluid source and at a first distance along the direction of advance of the print substrate, and for electromagnetically guiding a second drop of printing fluid from the jet printing fluid source so that it lands on the print substrate at a second distance along the direction of the axis of rotation of the print substrate from the jet printing fluid source, wherein the second distance is different from the first distance along the direction of the axis of rotation of the Print substrate, and means for causing a third drop to be deposited at least generally between the first and second drops after the drum has rotated and according to an interleaved print pattern, wherein the means for causing includes means for causing the third drop to be deposited such that the first and third drops are separated in time by about a full revolution of the drum.

21. The jet printer of claim 20 further including means for driving the printer to print half-tone images on the print substrate.

22. The jet printer of claim 20 wherein the print substrate is a printing plate.

* * * * *